US007292702B2

(12) United States Patent
Hagman

(10) Patent No.: US 7,292,702 B2
(45) Date of Patent: Nov. 6, 2007

(54) IN-WALL SPEAKER SYSTEM METHOD AND APPARATUS

(75) Inventor: Paul N. Hagman, Mount Vernon, WA (US)

(73) Assignee: Dimensional Communications, Inc., Mount Vernon, WA (US)

( * ) Notice: Subject to any disclaimer, the term of this patent is extended or adjusted under 35 U.S.C. 154(b) by 408 days.

(21) Appl. No.: 10/835,323

(22) Filed: Apr. 28, 2004

(65) Prior Publication Data

US 2004/0218777 A1 Nov. 4, 2004

Related U.S. Application Data

(60) Provisional application No. 60/466,461, filed on Apr. 29, 2003, provisional application No. 60/525,514, filed on Nov. 26, 2003.

(51) Int. Cl.
*H04R 1/02* (2006.01)

(52) U.S. Cl. ..... 381/345; 381/424; 381/152; 181/163; 181/150

(58) Field of Classification Search ..... 381/152, 381/345, 386, 431, 424; 181/150, 199, 163
See application file for complete search history.

(56) References Cited

U.S. PATENT DOCUMENTS

| | | | | |
|---|---|---|---|---|
| 3,164,221 | A * | 1/1965 | Rich | 181/163 |
| 3,636,281 | A | 1/1972 | Cozart | |
| 3,728,497 | A | 4/1973 | Komatsu | |
| 3,848,090 | A * | 11/1974 | Walker | 381/152 |
| 3,938,617 | A | 2/1976 | Forbes | |
| 4,330,691 | A | 5/1982 | Gordon | |
| 4,484,658 | A | 11/1984 | Grote | |
| 4,506,117 | A | 3/1985 | Fresard | |
| 4,903,300 | A | 2/1990 | Polk | |
| 4,923,032 | A | 5/1990 | Nuernberger | |
| 4,928,312 | A | 5/1990 | Hill | |
| 4,997,058 | A * | 3/1991 | Bertagni | 181/166 |
| 5,119,421 | A | 6/1992 | Reime | |
| 5,400,412 | A | 3/1995 | King, Sr. et al. | |
| 5,400,413 | A | 3/1995 | Kindel | |
| 5,425,107 | A * | 6/1995 | Bertagni et al. | 381/426 |
| 5,539,835 | A | 7/1996 | Bertagni et al. | |
| 5,546,469 | A | 8/1996 | Donahue | |

(Continued)

FOREIGN PATENT DOCUMENTS

FI WO96/28949 * 9/1996

*Primary Examiner*—Sinh Tran
*Assistant Examiner*—Joseph Saunders, Jr.
(74) *Attorney, Agent, or Firm*—Michael F. Hughes; Hughes Law Firm, PLLC

(57) ABSTRACT

The disclosure relates to an in-wall speaker system, specifically a system that is not readily visible and mounted in a room. The in-wall speaker system is comprised of a base frame that is adapted to be mounted between support members of a wall. The in-wall speaker system further has a speaker assembly mounted to the base frame and an active member that has an outer surface which is substantially coplanar with the surrounding wall section and in one form extends slightly outward therefrom. The base frame, speaker assembly, and the active member cooperate to form an acoustic chamber that is positioned behind the inner surface of the active member. Acoustic energy is transferred from the speaker assembly to the active member where the sound is produced therefrom to the room.

25 Claims, 7 Drawing Sheets

U.S. PATENT DOCUMENTS

| | | | | |
|---|---|---|---|---|
| 5,615,275 | A | 3/1997 | Bertagni et al. | |
| 5,693,917 | A | 12/1997 | Bertagni et al. | |
| 5,991,424 | A | 11/1999 | Bertagni et al. | |
| 6,154,555 | A | 11/2000 | Roark | |
| 6,332,029 | B1 * | 12/2001 | Azima et al. | 381/152 |
| 6,351,542 | B2 * | 2/2002 | Azima et al. | 381/345 |
| 6,385,326 | B1 | 5/2002 | Peng | |
| 6,925,191 | B2 * | 8/2005 | Petroff et al. | 381/423 |
| 6,929,091 | B2 * | 8/2005 | Bertagni et al. | 181/150 |
| 7,020,302 | B2 * | 3/2006 | Konishi et al. | 381/424 |
| 7,050,600 | B2 * | 5/2006 | Saiki et al. | 381/388 |
| 2003/0081800 | A1 * | 5/2003 | Klasco et al. | 381/152 |

* cited by examiner

IN-WALL SPEAKER SYSTEM METHOD AND APPARATUS

RELATED APPLICATIONS

This application claims priority benefit of U.S. Ser. No. 60/466,461, filed Apr. 29, 2003 and 60/525,514 filed Nov. 26, 2003.

BACKGROUND OF THE DISCLOSURE

Wall speaker systems have been used in various installation assemblies in order to discreetly produce music. Many systems are adapted to take advantage of the column of air between the studs and the commonly used dry wall layers. In modern day housing where living space is confined, there is a tremendous benefit with the inherent space saving aspects of in-wall speakers. Speakers themselves generally provide varying degrees of aesthetic value. Generally because the focus of speakers is to produce high quality sound, the speaker casing design effort is directed towards the acoustic properties of speaker assemblies and not the aesthetic aspects. Therefore, aesthetics and removal from view is a further demand for in-wall speakers. The in-wall speakers must still accomplish their utilitarian function of producing quality sound when they are not readily visible. By removing the speaker assemblies from immediate view, the listener can direct their vision toward objects that are designed for aesthetic appeal and still enjoy music or other sounds produced by the speaker assembly.

SUMMARY OF THE DISCLOSURE

As disclosed below, the disclosure shows embodiments for an in-wall speaker system adapted to be concealed in a room and mounted to support members. The in-wall speaker system comprises a base frame having an open area. There is a speaker assembly mounted to the base frame and the speaker assembly has a speaker frame and a reciprocating portion attached to the speaker frame. The reciprocating portion has a driver and a cone portion mounted to the speaker frame that is adapted to move in response to an audio input signal.

There is also an active member having a peripheral region connected to the base frame where the active member has an outward surface and an inward surface. The inward surface, the base frame and the speaker assembly define an acoustic chamber, whereby acoustic energy is transferred from reciprocating member of the speaker to the active member so that the outward surface transmits the acoustic energy as sound to the room.

DETAILED DESCRIPTION OF THE PREFERRED EMBODIMENTS

There will first be a general discussion of the environment where the in-wall speaker system 20 can operate, followed by a detailed discussion of the various embodiments of the in-wall speaker system 20. It is understood that the various embodiments disclose, in a general way, the underlying concept of the invention with the understanding that the invention is defined by the claims herein below.

Figure 1:
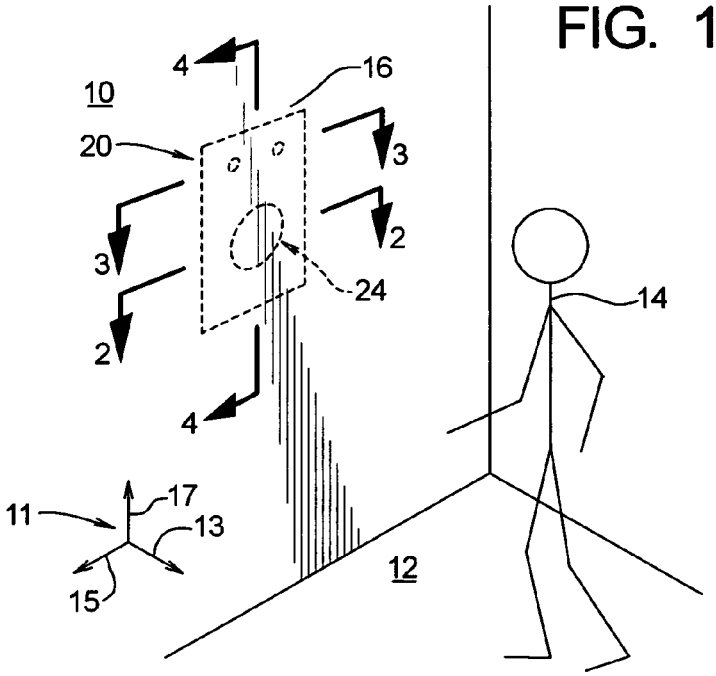
FIG. 1 shows an environmental view where the in-wall speaker system is shown as a hatched line hidden from the view of a listener.

As shown in FIG. 1, the in-wall speaker system 20 is mounted behind a wall section 10 that is a portion of a room generally indicated at 12. In one operation, a listener 14 will hear the acoustic output of the in-wall speaker system 20 without visually observing the source of the sound produced therefrom. The wall section 10 comprises a surrounding wall section generally indicated at 16. The surrounding wall section 16 indicates the general perimeter area around the in-wall speaker system 20. After a detailed discussion of the in-wall speaker system there will be a discussion of the installation and various installation options. To aid the general description, as shown in FIG. 1, an axes system 11 is generally defined where the arrow indicated at 13 indicates a longitudinal axis, the arrow 15 generally indicates a lateral axis and finally the arrow indicated at 17 indicates a vertical axis. The axes denote general directions and are no way intended to limit the invention to any specific orientation but rather aid in the description of the components discussed herein.

Figure 5:
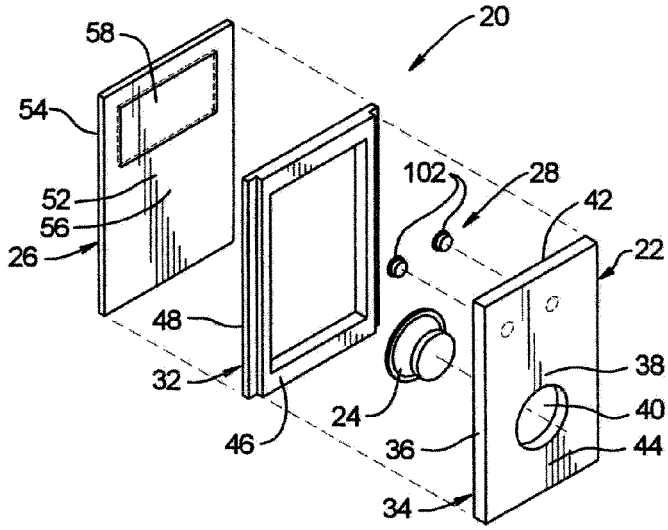
FIG. 5 shows the exploded view of an embodiment of the in-wall speaker system.
Figure 6:
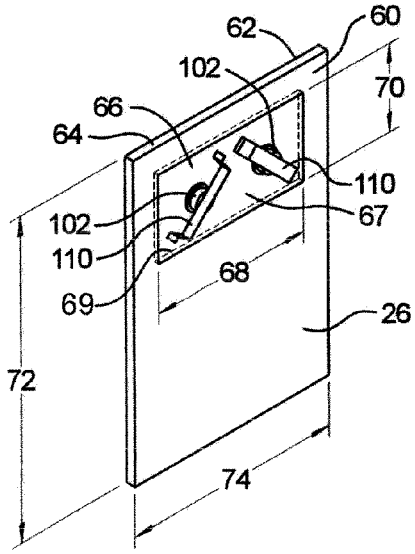
FIG. 6 shows another embodiment of a portion in-wall speaker system where the high-frequency elements are attached to a frame member or bracket that has portions which are attached to high-frequency non-reciprocating regions of the in-wall speaker system.

Now referring ahead to FIG. 5, the in-wall speaker system 20 comprises of a base frame 22, a speaker assembly 24 and an active member 26. Further, a high-frequency system 28 is employed that is adapted to better produce higher frequency sounds. FIG. 5 shows one method of installing the high-frequency elements 102. FIG. 6 shows a second method of installing the high-frequency elements 102 to the high-frequency region 58 discussed further below.

Referring back to FIG. 2, the in-wall speaker system is shown installed between support members 30*a* and 30*b*. The support members generally are wall studs made of wood or metal and spaced at or about 16 inches laterally from one-another. In one form, the in-wall speaker system 20 can be retrofitted to an existing wall installation, and in one form dry wall is set up and positioned on top of vertical support members such as those shown at 30*a* and 30*b*. In a retrofit situation, a portion of the dry wall is removed and the in-wall speaker system 20 is positioned in the location of the removed dry wall. Thereafter, traditional dry wall techniques, such as spackling, can be applied to the perimeter region to smooth the transition from the surrounding wall section 16 (see FIG. 1) and the active member 26. The in-wall speaker system 20 can also be installed during a dry wall set up where the installers provide for an open region that corresponds to the approximate size of the in-wall speaker system 20. Thereafter, spackling or the like is applied to the perimeter region to smooth the transition between the surrounding wall section and the active member. The active member is adapted to have paint applied thereto to hide the active member out of sight of individuals listening to music 14.

There will now be a discussion of the components of the in-wall speaker system 20. It should be understood that the various components are one method of employing the invention where the invention resides in the claims. The base frame 22 in one form comprises a perimeter frame 32 and a rear baffle 34. The rear baffle 34 has a perimeter region 36 and a central region 38. In one form, located in the lower central region, there is a surface defining an open area 40 having a perimeter region that is adapted to mount the speaker assembly 24 thereto. The rear baffle 34 has a forward surface 42 and a rearward surface 44. The perimeter frame 32 has a rearward perimeter surface 46 that is adapted to mount to the forward surface 42 of the rear baffle 34. The perimeter frame 32 further has a forward perimeter surface 48 that is adapted to mount to the perimeter region of the active member 26 described further below. As shown in the lower portion of FIG. 4, the perimeter frame 32 has a longitudinal thickness 50 that is such to define a proper spacing between the forward surface 42 of the rear baffle 34 and the inner surface 52 of the active member 26. The significance of the spacing is described further below.

There will now be a discussion of the active member 26 followed by a discussion of the speaker assembly 24 and the high-frequency system 28. As shown in FIG. 5, the active member 26 has a rearward surface 52 (otherwise referred to an inward surface 52 and a forward surface 54 (otherwise referred to as the outer surface 54). As shown in FIG. 5, the rearward surface 52 has a low-frequency-reciprocating region 56 and a high-frequency region 58. The high-frequency surface has a portion of the high-frequency system 28 along with the high-frequency elements described further below. In general, the active member 26 has a reciprocating area located in the central region thereof. The reciprocating area can be broken down to a low-frequency reciprocating area and a high-frequency reciprocating area. The low-frequency reciprocating area is the general area of the active member 26 that vibrates to produce lower frequency sounds. This can be a portion of the high-frequency region 58 where the higher frequency vibrations vibrate on top of the lower frequency vibrations. In other words, while the active member 26 is vibrating to produce lower frequency sound, the high-frequency region 58 can be additionally vibrating at a higher frequency to produce additional sound vibrations. The high-frequency reciprocating area is generally located at the high-frequency region 58. Because the high-frequencies generally have less travel in the longitudinal direction, the high-frequency reciprocating area can be of a much smaller surface area than the low-frequency reciprocating area. For example, as shown in FIG. 6, the driver portions of the high-frequency elements 102 create a localized high-frequency reciprocating area where the distal portions of the high frequency system 28 are attached to the high-frequency non-reciprocating areas which can be portions of the base frame. However, the high-frequency non-reciprocating areas still may be a portion of the low-frequency reciprocating area. The non-reciprocating areas do not produce as much sound, or none at all for the respective frequency ranges.

Referring to FIG. 6, the active member 26 in one form comprises an inner material 60, an outer material 62 and a foam like structure 64 interposed between the inner and outer materials 60 and 62. The material to make the active member 26 is referred to as "foam core" and the inner and outer materials 60 and 62, along with the center foam aggregate provide the requisite rigidity and moderate flexibility to handle the acoustic coupling of the acoustic chamber 100 discussed further herein. The thickness of the active member can be between 1/16 of an inch to 5/8 of an inchor more specifically a width of 2/16 of an inch to 5/16 of an inch. The applicant has been successful with an active member 26 that is 3/16 of an inch thick.

In one form of making the high-frequency region 58, a portion of the inner surface 60 is removed as well as a certain amount of depth of the foam like structure 64. Thereafter, a high-frequency plate 66 is inserted in the open area of removed material. The high-frequency plate 66 has a high-frequency inward surface 67 and a perimeter region 69 that surrounds the perimeter of the high-frequency inward surface 67. The high-frequency plate 66 in one form is roughly twenty thousands of an inch and is relatively rigid, firm and adapted to resonate at higher frequencies between the broad range of 400-20,000 hertz and a more focused range of 500-14,000 hertz. A further focused vibration range for the high-frequency plate 66 is between 800-12,000 hertz. In one form, the high-frequency plate 66 is a wood sheet veneer product made out of about 0.020 inch thickness of wood.

Figure 2:
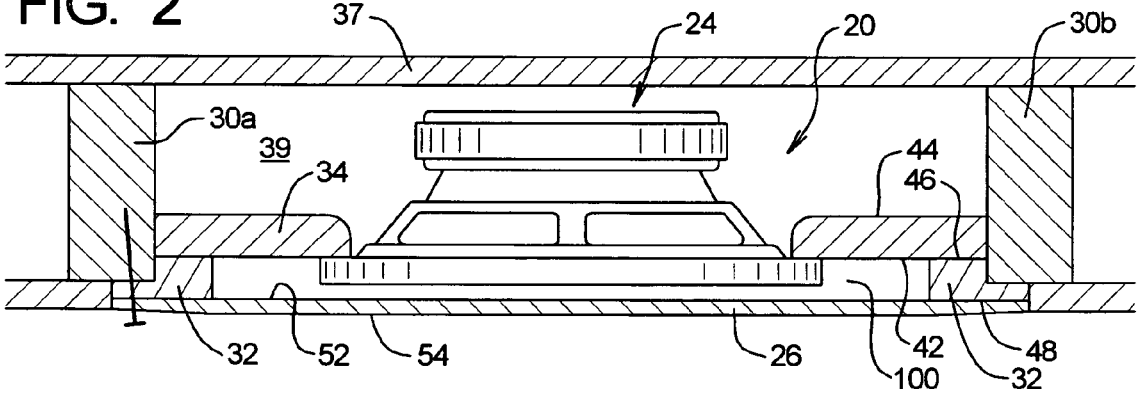
FIG. 2 is a partial cross sectional view taken at line 2-2 in FIG. 1 of the speaker assembly.
Figure 3:
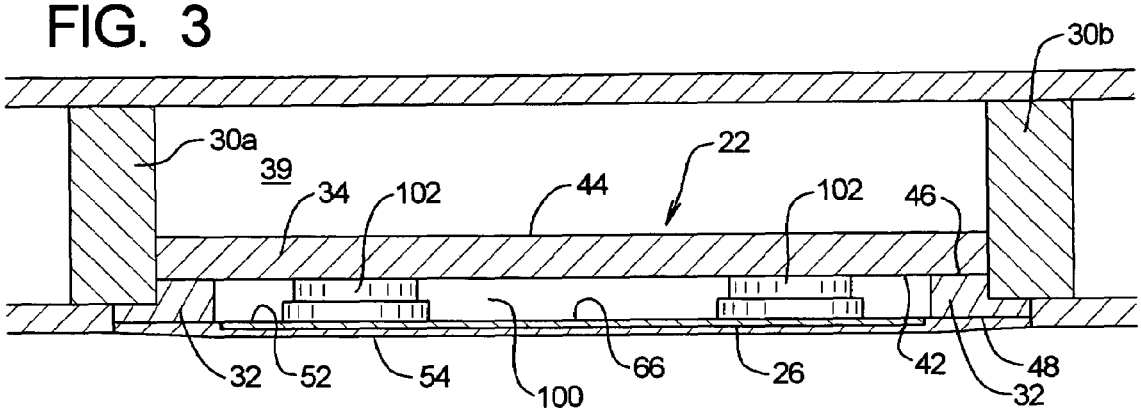
FIG. 3 shows a partial cross sectional view of the high-frequency region where high-frequency elements are connected to the reciprocating area on the active member of the high-frequency region.

As shown in FIG. 6, the high-frequency plate 66 has a lateral width of the dimension 68 and a height dimension 70. Further, the active member 26 has a vertical dimension indicated at 72 and a width dimension indicated at 74. In general, the width dimension 74 is the average width between the support members 30*a* and 30*b* as seen in FIGS. 2-3. In general, the difference between the width 74 of the active member 26 and the width 68 is such to allow for a perimeter spacing region so the perimeter region of the active member 26 can mount to the forward perimeter surface 48 of the perimeter frame 32 and to isolate active member 26 from perimeter region. In one form, the active member 26 has a forward surface 54 that is a wood sheet veneer approximately 0.020 inch thick that is a part of a wood siding for a wall.

The perimeter region 69 of the high-frequency inward surface is located closer to the forward perimeter surface 48 of the perimeter frame 32 where the rearward surface 52 of the active member 26 is mounted. The central region of the high-frequency inward surface is adapted to resonate to produce a majority of the sound. As discussed further below, the high-frequency elements that are mounted to a frame 110 that can be attached to the perimeter region 69 and still produce higher frequency sounds discussed further below. It should be noted that the rearward surface of the bracket 110, in one form, does not contact the forward surface 42 of the rear baffle 34. This allows the high-frequency reciprocating region to double as the low-frequency reciprocating region where there is a frequency overlay and the high-frequency vibrations of the high-frequency plate 66 occur in conjunction with the low-frequency vibrations of the whole active member 26.

Figure 2A:
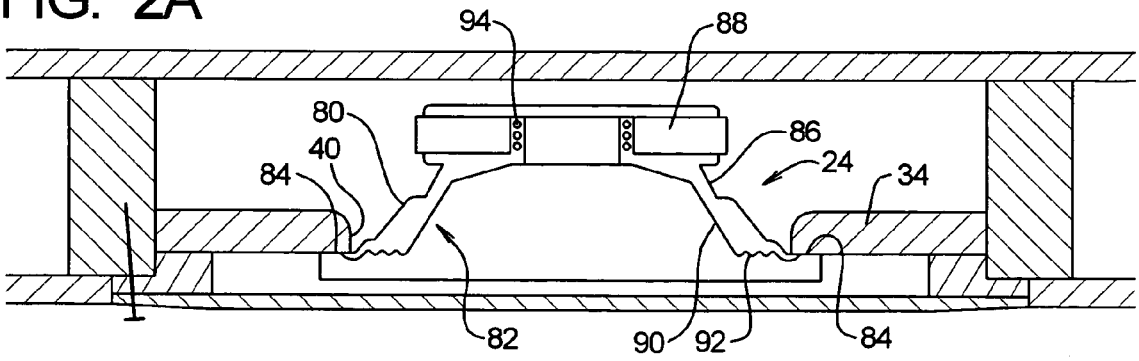
FIG. 2A is a full cross sectional view taken at line 2-2 in FIG. 1 of the speaker assembly.

There will now be a discussion of the speaker assembly with reference to FIG. 2A. As shown in this figure, the speaker assembly 24 comprises a speaker frame 80 and a reciprocating portion 82. The speaker frame 80 in one form has a guide commonly referred to as a spider and has a first perimeter region 84 that is adapted to mount to the open area 40. In one form the speaker frame could be part of the rear baffle 34 and the reciprocating portion 82 is directly mounted thereto. The second perimeter region 86 is adapted to mount to a static permanent magnet 88. The permanent magnet 88 provides a field of magnetic flux from the outer magnet portion to the inner concentric portion.

The reciprocating portion 82 in one form comprises a cone 90, a surround 92 and a voice coil 94. The voice coil is adapted to reposition in the longitudinal direction with respect to the current flowing therethrough. The voice coil in turn repositions the cone 90 to displace air and create sound. The operational element of the reciprocating portion attached to the speaker frame is to displace air at desirable frequencies to produce sound from an electric input wave. The reciprocating portion 82 is defined broadly to encompass any air-moving device that displaces air or other gas in order to create sound or otherwise change the volume of the acoustic chamber 100 to create sound on the active member 26. The reciprocating portion 82 in a conventional form is a conventional speaker that can be retrofitted to the open area 40. However, other types of air displacing devices that are presently foreseeable and suitable for this application can be employed.

Figure 4:
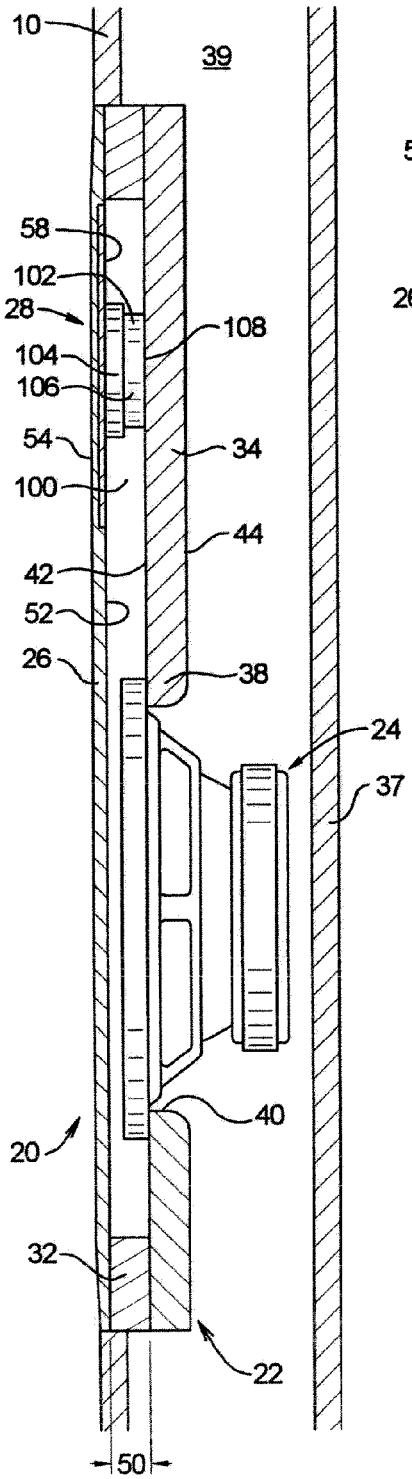
FIG. 4 shows a side partial cross sectional view of the in-wall speaker system.

Therefore, an acoustic chamber 100 is defined between the inward surface 52 of the active member 26, the base frame 22 in the speaker assembly 24. The acoustic chamber is substantially hermetically sealed and is adapted to transfer acoustic energy from the reciprocating portion 82 of the speaker assembly 24 to the active member 26. The active member thereby transfers the acoustic energy to the surrounding room 12 as shown in FIG. 1. The distance 50 as shown in FIG. 4 is kept to a minimum so the volume of the acoustic chamber is minimized so the capacitance effect is lowered and the transfer of energy is greater.

There will now be a discussion of the high-frequency system. The high-frequency system comprises of the high-frequency region 58 and the high-frequency elements 102 that are best seen in FIG. 4. The high-frequency elements 102 can be NXT Exciters™ that are conventional in the marketplace. However, other drivers that respond to higher frequency input signals can be employed. The high-frequency elements 102 comprise a driver portion 104 and a base region 106. The base region 106 has a rear surface 108 that is adapted to be effectively mounted to the base frame 22. Spacers can be employed that are simply thin disk like members so the overall longitudinal distance of the high-frequency elements 102 are substantially to that of distance 50 as shown in FIG. 4.

Effectively mounting the base region 106 of the high-frequency elements 102 to the base frame 22 is defined as attaching the base region 106 to a substantially non-reciprocating portion of the inner wall speaker system 20. Therefore, as shown in FIGS. 4 and 5, one method of effectively mounting the base region 106 to the high-frequency elements 102 to the base frame 22 is strictly attaching the rear surface 108 to the forward surface 42 of the rear baffle 34. Alternatively, as shown in FIG. 6, the base regions of the high-frequency elements 102 are attached to bracket members 110. The bracket members 110 have a central region and distal regions. The distal regions are attached to substantially non-reciprocating portions of the active member 26. The non-reciprocating portions of the active member 26 are roughly positioned around the perimeter region near where the active member 26 is connected to the perimeter frame 32. The central region of the rearward surface 52 of the active member 26 will reciprocate and oscillate greater than the perimeter regions of the same. The applicant has successfully mounted the high-frequency elements 102 in a manner as shown in FIG. 6 and achieved desirable higher frequency output of the high-frequency system 28.

It can therefore be appreciated that the lower frequencies are generated by an acoustic coupling between the speaker assembly 24 and the active member 26 via the acoustic chamber 100. However, the higher frequency sounds are generated by the high-frequency system 28 by a direct drive type system where the driver portion 104 of the high-frequency element 102 directly reciprocates a high-frequency region 58. It should further be noted that in one form, the high-frequency region 58 is located on the low-frequency reciprocating region 56 of the active member 26. Of course other forms of the invention can be employed where the high-frequency region 58 is separated from the low-frequency reciprocating region 56.

Figure 9:
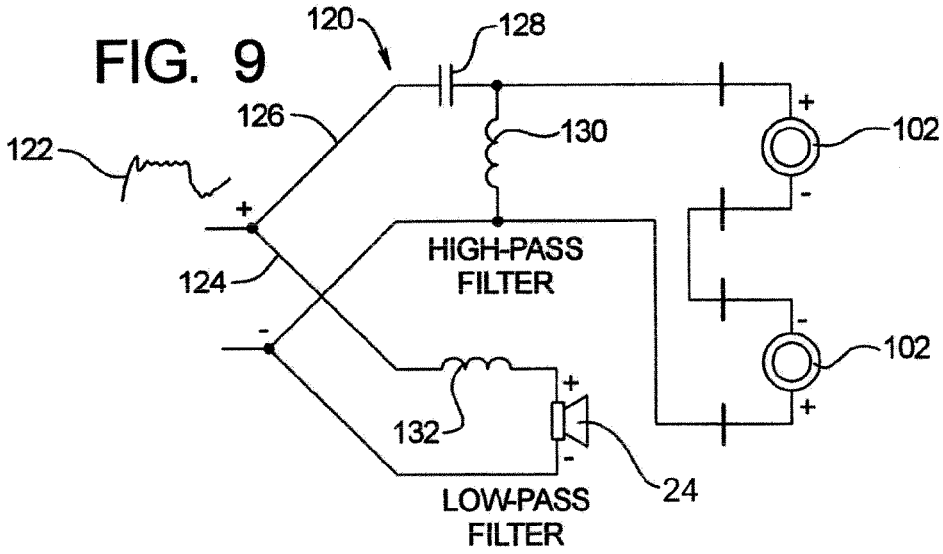
FIG. 9 is a schematic view of a circuit that can be employed in the in-wall speaker system.

Now referring ahead to FIG. 9, a circuit 120 is shown that is adapted to send the higher frequency signals to the high-frequency system 28 (as shown in FIG. 4) and the lower frequency signals to the speaker system 24 (as shown in FIG. 5). The circuit 120 in operation has an input signal 122 sent to lines 124 and 126 where a capacitor 128 and inductor 130 are employed as well as the inductor 132 to separate the frequency ranges of the incoming signal 122. The high-frequency elements 102 are positioned in series where the capacitor 128 is adapted to allow the higher frequencies to pass to these elements. The inductor 132 will filter out the higher frequencies so the speaker assembly 24 will only receive lower frequency signals.

In one operation, the inner wall speaker system had a peak frequency response of about 500 hertz. This frequency response was problematic when music was placed through the in-wall speaker system 20 because the vocal range, or a portion of it, is roughly around 500 hertz. Therefore, the passive crossover circuitry as shown in FIG. 9 will deliver a proper frequency distribution to the speaker assembly 24 and the high-frequency elements 102.

Figure 10:
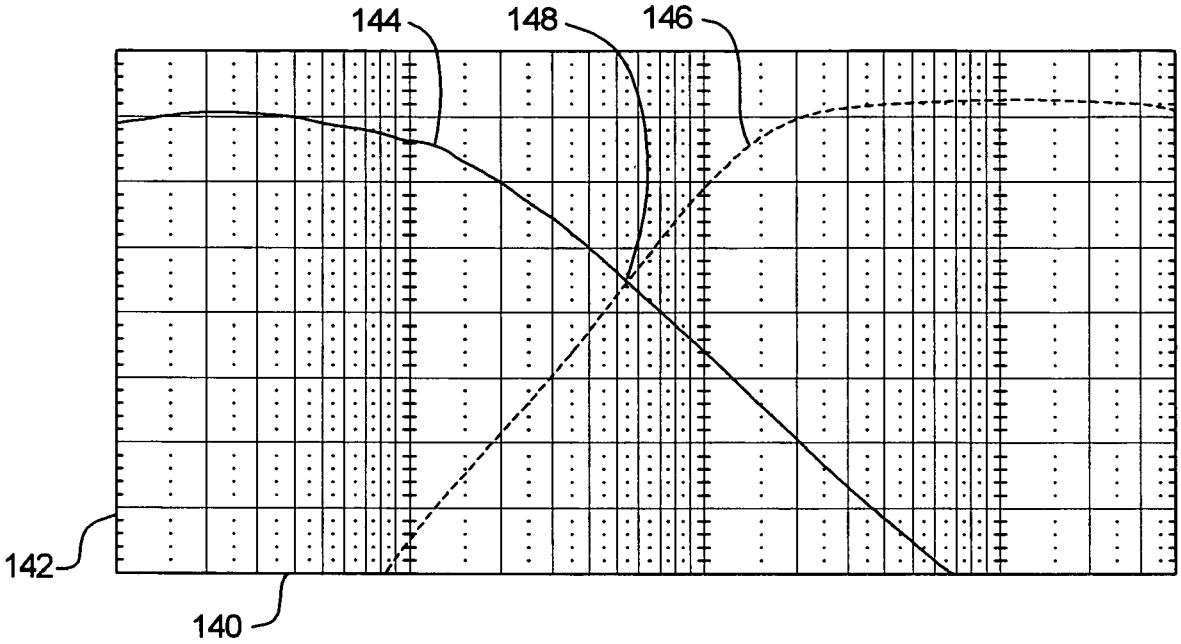
FIG. 10 is a logarithmic graph showing one possible frequency response of the speaker assembly and a cross-over region.

In one form, as shown in FIG. 10 there is a logarithmic graph indicating the frequencies on the x-axis 140 and the gain indicated on the y-axis 142. The line 144 indicates the gain with respect to the frequency that is sent to the speaker assembly 26. The line 146 indicates the gain with respect to the frequencies that are sent to the high-frequency system 28. The crossover point 148 is the acoustic peak point and the parameters of the circuit in FIG. 9 are adjusted by one skilled in the art depending upon the materials used for the in-wall speaker system 20. As mentioned above, in one form, the frequency response of the in-wall speaker system 20 has been found to be approximately 500 hertz. Therefore, the crossover point 148 would be sent to this frequency response of 500 hertz. In the broader range, such frequency response can be between 300-1200 hertz.

Figure 7:
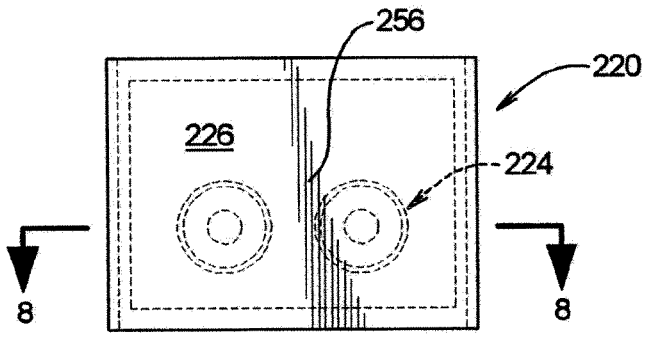
FIG. 7 shows a front view of another embodiment of the in-wall speaker system where two speaker assemblies are employed.
Figure 8:
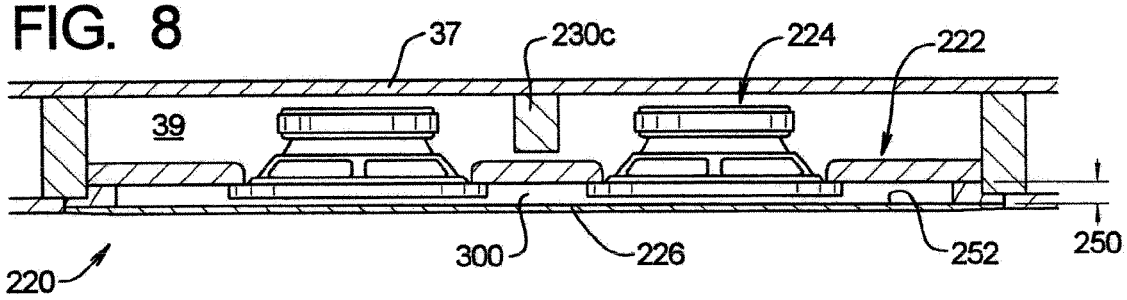
FIG. 8 is a partial top cross sectional view of the embodiment of the in-wall speaker system taken at line 8-8 of FIG. 7.

Now referring back to FIGS. 7 and 8, there is shown another embodiment where similar components having similar numerals are designated the same except increased by a value of two hundred (e.g. 20→220). As shown in these figures, the in-wall speaker system 220 comprises a base frame 222, a speaker assembly 224 and an active member 226. The in-wall speaker assembly 220 is substantially similar to the previous embodiments except the speaker assembly comprises two speaker systems to displace sound in the acoustic chamber 300. As shown in FIG. 8, the support member 230*c* is shortened in the longitudinal direction to account for the base frame 222. In a retrofit application, a portion of the support member 230*c* can be removed or, when constructing a new wall, the support member 230*c* can be fitted as a smaller unit at that time or alternatively the support member 230*c* is rotated 90° so the narrower portion extends longitudinally to fit the in-wall speaker system 220 in the wall section.

Because the lateral width of the reciprocating region 256 is greater, there is potential for a greater reciprocating motion. Having a plurality of speaker assemblies 224 allows for greater distillation of volume in the acoustic chamber 300. Therefore the active element 226 can vibrate at a greater distance in the longitudinal direction. The distance indicated at 250 must be sent accordingly so the inner surface 252 does not come in contact with the inner portions of the acoustic chamber 300 such as the speaker assemblies 224.

The various components of the in-wall speaker system 220 are similar to the embodiments described above. A high-frequency system similar to the high-frequency system 28 above can be employed in the embodiments shown in FIGS. 7 and 8. In one form, the in-wall speaker system 220 as shown in FIGS. 7 and 8 can be employed in conjunction with the in-wall speaker system 20 shown above. For example, as shown in FIG. 1, the in-wall speaker system 20 can be one of a plurality of systems placed at various locations on the wall 10. The in-wall speaker system 220 can be positioned in conjunction with the other systems. It has been found advantageous to position the in-wall speaker system 220 at a lower elevation below the systems shown in previous Figures. The particular large surface area of the active member 226 is conducive for producing higher amplitude bass frequencies.

As shown in FIGS. 2, 3, 4, and 8, a rearward wall 37 is positioned rearwardly of the in-wall speaker system 20. The speaker assembly 24 is such that it can conveniently fit between the surrounding wall section 10 and the rearward wall 37. This distance is between 1-6 inches and more specifically between 3 to 4 inches. The rearward wall 37 defines an open chamber 39 that is preferably of a large volume to minimize resistance of the motion of the reciprocating portion 82 of the speaker assembly 24 (see FIG. 2A).

In a preferred installation the in-wall speaker system 20 is positioned approximately 6 feet above the floor. This spacing allows for pictures or the like to be hung on the wall. When installing the in-wall speaker system 20, self-adhesive fiberglass mesh drywall joint tape can be used to bridge the gap between the perimeter frame and the surrounding wall. The acoustic performance of the assembly 20 could vary depending upon the installation and the exterior coating on the panel 26. A frequency tuner (graphic equalizer) can be employed to compensate for frequency damping at any particular range.

In one preferred form of installation, as shown in FIGS. 2, 3, 4 and 8, the central region of the active member is slightly displaced longitudinally outward from the surrounding wall section 10 as shown in FIG. 1. This is advantageous because it has a tendency for the installer to stop spackling at the perimeter region of the active member 26. This is advantageous because less material is positioned on the reciprocating area of the active member 26. In one form, the outer surface 54 of the active member 26 can extend outwardly between 1/16 of an inch up to three quarters of an inch. A more specific range of the outward projection of the active member 26 is between 1/8 of an inch to 1/2 of an inch. These ranges allow the outer surface 54 to be substantially in line with the surrounding wall sections 10. Of course it is possible to have the outer surface 54 to be directly coplanar with the surrounding wall section or sunken therein as the circumstances call for.

Figure 11:
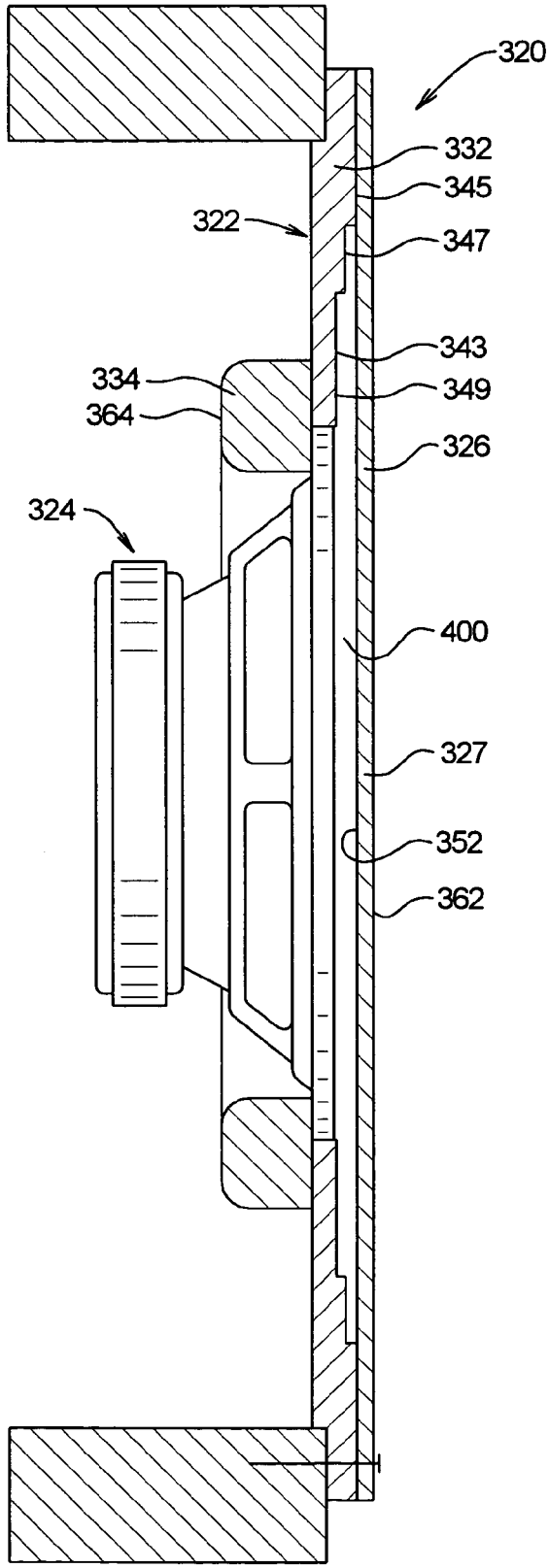
FIG. 11 shows a top partial cross sectional view of another embodiment of the in-wall speaker system.
Figure 12:
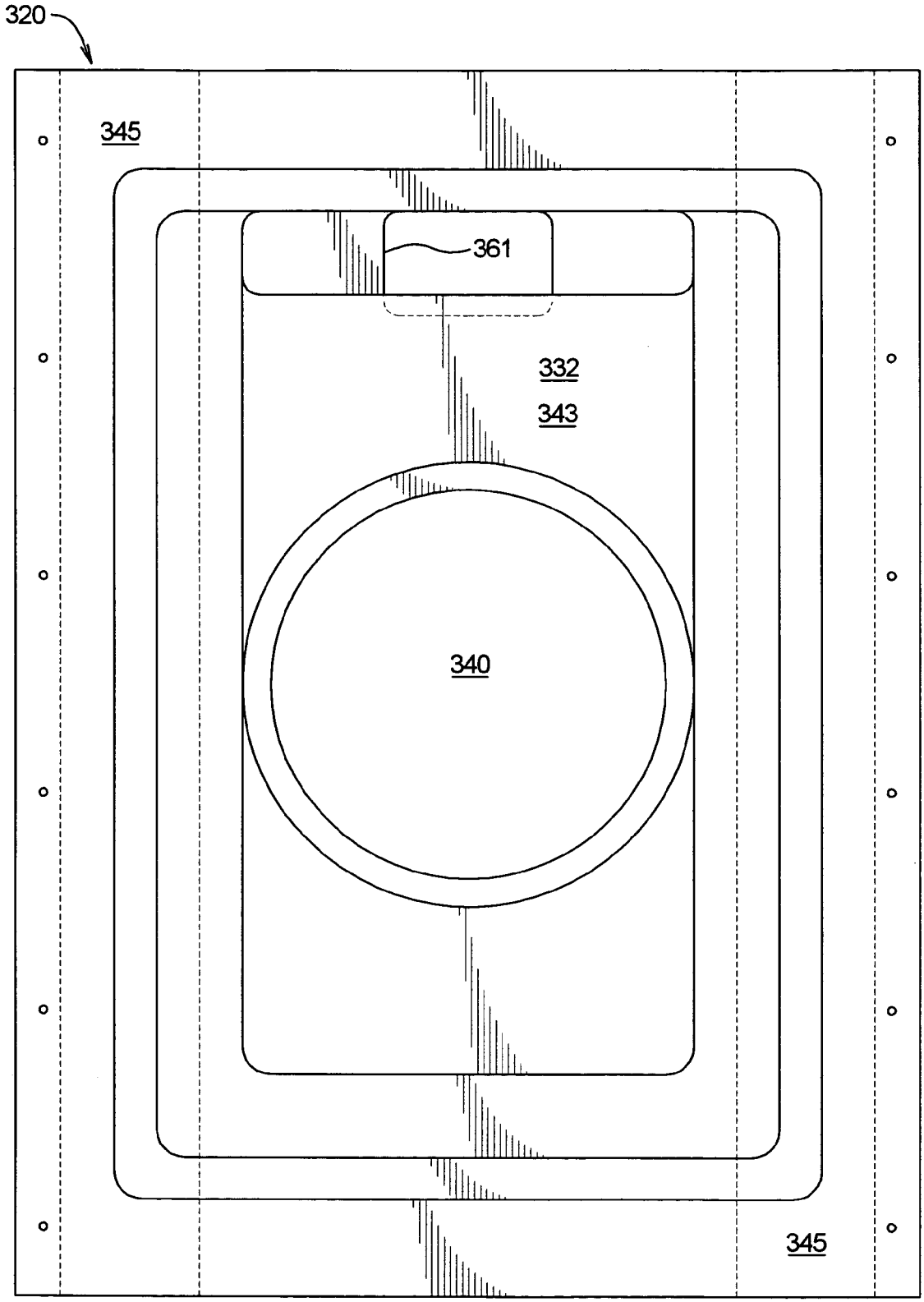
FIG. 12 is a front view of another embodiment of the in-wall speaker system.

Now referring to FIGS. 11-12, there is another embodiment of the in-wall speaker system 320 that comprises a base frame 322, a speaker assembly 324 and an active member 326. The embodiment as shown in FIGS. 11-12 is substantially similar to the previous embodiments but the perimeter frame 332 having the forward surface 343 is such that it comprises a step down tier system whereby the surface 343 comprises a perimeter engagement surface 345 that is adapted to engage the rearward surface 352 of the active member 326. The surface 343 comprises progressive step-down sections 347 and 349 that in one form can be milled out. This surface arrangement is advantageous because the progressive repositioned surface in the longitudinally rearward direction accommodates the natural displacement of the active member 326 when in use. In other words, the center portion 327 of the active member will displace the greatest distance in the longitudinal direction. Therefore, in order to keep the acoustic chamber 400 to a minimal volume, a progressively stepped or slanted surface minimizes the volume of the acoustic chamber 400 and does not interfere or come in contact with the rearward surface 352 of the active member 326.

The embodiments as shown in FIGS. 11-12 further illustrate alternative proportions for the perimeter frame 332 and the rear baffle 334. As shown in FIG. 12, there is a front view of the speaker assembly 320. The rear baffle 334 defines the open area 340 where the speaker assembly 324 as shown in FIG. 11 is adapted to be fitted therein. Located in the upper portion in FIG. 12 is an opening defined by a surface 361 of the rear baffle 334. A high-frequency element such as that as the elements 102 shown in FIGS. 4-5 are to be employed where it is positioned in the open area defined by the surface 361 and the driver portion 104 of these elements is fixedly attached to the rearward surface 352 of the active member 326. One or more high-frequency elements can be employed. A back plate (not shown) is used to engage the base region such as a base region 106 in the previous embodiments whereby the back plate is rigidly attached to the base frame 322. As can be seen in FIG. 11, the rearward surface 364 of the baffle 334 is a sufficient distance from the inward surface 352 of the active member so that a longer high-frequency element can be positioned in the opening defined by the surface 361 as shown in FIG. 12.

In one form the high frequency reciprocating area is in communication with the acoustic chamber. Alternatively, the high frequency reciprocating area is in communication with the acoustic chamber; however, the high frequency reciprocating area could in one form have a separate chamber or be divided by a flexible membrane.

A thin vinyl layer with adhesive is attached to the inner surface of the active member 326 in a similar manner as shown in FIGS. 3 and 4 above to define a high-frequency region. One objective is to get the layer as thin as possible and as pliable as possible, but strong enough to withstand the vibration. A variety of materials can accomplish this goal. The material used in the high frequency region should be thicker than the inner material of the active member and stronger and/or stiffer. If the active member takes other forms, the material used in the high frequency area should be stronger, and stiffer than the material that comprises the reciprocating portion of the active member. In one form, where there is an exterior such as a thin wood layer that covers the outer surface of the active member 326 and the surrounding wall sections, the excavation of the interposed foam like structure is up to the inner surface of the outer material 362 as shown in FIG. 11 and no intermediate layer is employed.

It should be noted that when the final installation is complete as shown in FIG. 1, the in-wall speaker installation is not visible particularly when the active member has paint or wallpaper over the outer surface. One method of locating the speaker after the final installation is to tap the wall with a finger or other instrument. The active member 26 will generally give a higher frequency acoustic sound than the surrounding wall portions 10.

Therefore, it can be appreciated that the elements of a base frame that can comprise one or more members and is adapted to be attached to support structures such as studs or horizontally extending members such as support beams of the ceiling where the apparatus has inner surface defining an acoustic chamber that is in communication with a speaker assembly or other like air displacing sound producing device. Further, in one form an embodiment includes the excavation of the rearward portion of foam core and placing a rigid thin material therein that is adapted to be operatively connected to a high-frequency member to produce higher frequency sounds. In one form the apparatus is mounted to a vertical wall with support studs; however, in the broader scope the apparatus can be utilized in ceiling surfaces and in such environments such as ceilings for porches and outdoor decks.

It can therefore be appreciated that the above embodiments show one mode of exercising the present invention where the broader scope is preserved in the claims below. It should be appreciated that the above implementation shows one method of employing the claimed invention and is in no way intended to limit the scope of the claims.

I claim:

1. An in-wall speaker system operatively configured to be concealed and mounted to support members adjacent to a surrounding surface, said in-wall speaker system comprising:

a base frame having an open area and perimeter region where at least a portion of the perimeter region is operatively configured to be mounted to the support members, a speaker assembly mounted to said base frame and comprising:

i. a speaker frame and ii. a reciprocating portion attached to said speaker frame and comprising a driver and a cone portion mounted to the speaker frame and adapted to move in response to an audio input signal, a high frequency element having a driver portion and a base region, an active member having a peripheral region connected to the base frame where the active member having an outward surface and an inward surface where the inward surface of the active member has a high-frequency region having a high-frequency inward surface mounted to the driver portion of the high-frequency element and where the inward surface, the base frame, and the speaker assembly define an acoustic chamber, whereby acoustic, energy is transferred from reciprocating member of the speaker to the active member so that the outward surface transmits the acoustic energy as sound to the room and the active member having a low-frequency region and a high-frequency region, the high-frequency region attached to the driver portion of the high frequency element within the acoustic chamber, whereas the outward surface is operatively configured to be substantially contiguous with the surrounding surface and where the base region of the high-frequency element is directly attached to the base frame.

2. The in-wall system as recited in claim 1 where the outward surface of the active member is substantially in line with surrounding wall portions of the room.

3. The in-wall system as recited in claim 2 where the outward surface has a peripheral region adapted to be spackled and the outward surface is adapted to have paint or other coating applied thereto.

4. The in-wall speaker system as recited in claim 1 where the speaker reciprocating portion has a front face which is directly opposing the inward surface of the active member.

5. The in-wall speaker system as recited in claim 1 where the acoustic chamber volume is kept to a minimum.

6. The in-wall speaker system as recited in claim 1 where the active member is comprised of a foam like structure having an outer material, and inner material and a foam like material interposed between the outer and inner material.

7. The in-wall speaker system as recited in claim 1 where the high-frequency region comprises a veneer wood material.

8. The in-wall speaker system as recited in claim 1 where the active member is comprised of a foam like structure having an outer material, an inner material, and a foam like material interposed between the outer and inner material.

9. The in-wall speaker system as recited in claim 8 where the high-frequency region comprises a material that is thicker and stiffer than the inner material of the active member.

10. The in-wall speaker system as recited in claim 1 where the high-frequency region comprises a material that is stiffer and stronger than the low-frequency region of the active member.

11. The in-wall speaker system as recited in claim 1 where the high-frequency inward surface has a perimeter region and a base region of the high-frequency element is attached to a bracket that is attached to the perimeter region of the high-frequency inward surface.

12. The in-wall speaker system as recited in claim 1 where the active member is comprised of a foam like structure having an outer material, inner material and a foam like material interposed between the outer and inner material and where the high-frequency region is comprised of a rigid material that replaces a portion of the inner material.

13. The in-wall speaker system as recited in claim 12 where the driver portion of the high-frequency element is attached to a high-frequency reciprocating area and the base region is attached to a high-frequency non-reciprocating area which is part of the base frame.

14. The in-wall speaker system as recited in claim 12 where the base region of the high-frequency element is attached to a high-frequency non-reciprocating area where the base region is attached to a mounting bracket having distal ends that are attached to the high-frequency non-reciprocating areas of the in-wall speaker system on the base frame.

15. An in-wall speaker system concealed in a room, the in-wall speaker system comprising:

a base frame having rearward portions and speaker frame portions, a reciprocating portion having a peripheral region mounted to the speaker frame portions, and a driver adapted to move the reciprocating portion, an active member having a perimeter region mounted to the base frame where the active member has an outer surface and an inward surface where the inward surface of the active member has a high-frequency region and where the inward surface, the base frame, and the reciprocating portion define an acoustic chamber adapted to transmit energy from the reciprocating portion to the active member, a high-frequency system having a high-frequency region positioned on the active member where a high-frequency element positioned within the acoustic chamber and having a driver portion and a base region where the driver portion is mounted to a high-frequency reciprocating area of the high-frequency region and the base region is mounted to the base frame.

16. The in-wall system as recited in claim 15 where the outward surface of the active member is substantially in line with surrounding wall portions of the room.

17. The in-wall system as recited in claim 16 where the outward surface has a peripheral region adapted to be spackled and the outward surface is adapted to have paint or other coating applied thereto.

18. The in-wall speaker system as recited in claim 15 where the speaker reciprocating portion has a front face which is directly opposing the inward surface of the active member.

19. The in-wall speaker system as recited in claim 15 where the acoustic chamber volume is kept to a minimum.

20. A method of producing sound in a room whereby the sound source is not readily visible, the method comprising:

mounting a base frame on wall supports the base frame having a perimeter region and an open region, positioning a speaker assembly in the open region of the base frame where the speaker element has a stationary region and a movable region whereby the movable region transmits sound from an input signal, attaching a base region of a high frequency element to the base frame mounting an active member on to the perimeter region base frame whereby creating an acoustic chamber between and inner surface of the active member and the base frame and the movable region of the speaker assembler where the inward surface of the active member has a high-frequency region having a high-frequency inward surface mounted to a driver portion of the high-frequency element, whereas sound is produced to the room by vibrations of the active member which are transferred through the acoustic chamber from the movable portion of the speaker assembly and higher frequencies are transmitted from the high-frequency region of the active member.

21. The method as recited in claim 20 where the high-frequency region comprises a wood veneer product.

22. The method as recited in claim 20 where the high-frequency region is a portion of the active member.

23. The method as recited in claim 22 where the active member is comprised of a foam like structure having an outer material, inner material and a foam like material interposed between the outer and inner material and where the high-frequency region is comprised of a rigid material that replaces a portion of the inner material where the high-frequency region is defined by a high-frequency response material positioned adjacent to the inner core foam material of the active member.

24. The method as recited in claim 23 where the high-frequency region has a frequency response between 500 hertz and 12,000 hertz.

25. The method as recited in claim 20 where a circuit passes higher frequency electronic waveforms to the high-frequency element and lower frequency electronic waveforms are passed to the speaker assembly.

* * * * *